US007637493B2

(12) United States Patent
Ogawa

(10) Patent No.: US 7,637,493 B2
(45) Date of Patent: Dec. 29, 2009

(54) INTERMITTENT DRIVE MECHANISM, SHEET FEEDER, AND IMAGE FORMING APPARATUS

(75) Inventor: Daisuke Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 35 days.

(21) Appl. No.: 11/933,710

(22) Filed: Nov. 1, 2007

(65) Prior Publication Data

US 2008/0099985 A1 May 1, 2008

(30) Foreign Application Priority Data

Nov. 1, 2006 (JP) ..... 2006-297834

(51) Int. Cl.
*B65H 3/06* (2006.01)
*F16H 55/17* (2006.01)

(52) U.S. Cl. ..... 271/114; 74/435

(58) Field of Classification Search ..... 271/114; 74/435, 640, 54, 53, 47
See application file for complete search history.

(56) References Cited

U.S. PATENT DOCUMENTS 4,217,057 A * 8/1980 Nakamura ..... 400/636
5,944,305 A * 8/1999 Takashima et al. ..... 271/127
6,991,392 B2 * 1/2006 Hult et al. ..... 400/624
7,270,323 B2 * 9/2007 Somemiya ..... 271/127

FOREIGN PATENT DOCUMENTS

JP 4-63849 U 5/1992
JP 7-235029 A 9/1995
JP 09-236163 9/1997
JP 11-106069 4/1999
JP 2003-262262 9/2003
JP 2003262262 A * 9/2003
JP 2003-292178 A 10/2003

OTHER PUBLICATIONS

JP Office Action dtd Sep. 30, 2008, JP Appln. 2006-297834.

* cited by examiner

*Primary Examiner*—Patrick H Mackey
*Assistant Examiner*—Ernesto Suarez
(74) *Attorney, Agent, or Firm*—Banner & Witcoff, Ltd.

(57) ABSTRACT

An intermittent drive mechanism capable of noise reduction is provided. The intermittent drive mechanism comprises a drive gear, a fragmental gear, a first cam, an operating arm, an operating-arm drive mechanism, and a brake mechanism. The fragmental gear includes a mesh portion, of which teeth arranged in a predetermined region on a circumference mesh with the drive gear, and a non-mesh portion, which is free of teeth in the remaining region on the circumference and so does not mesh with the drive gear. The first cam rotates integrally with the fragmental gear. The operating arm contacts with the first cam to rotate the fragmental gear so as to put the same in a mesh state, in which the mesh portion meshes with the drive gear, from an optional, initial position in a non-mesh state, in which the non-mesh portion faces the drive gear. The operating-arm drive mechanism drives the operating arm upon energization of a solenoid. The brake mechanism restricts rotation of the fragmental gear at least when the fragmental gear is disposed in the initial position.

8 Claims, 14 Drawing Sheets

INTERMITTENT DRIVE MECHANISM, SHEET FEEDER, AND IMAGE FORMING APPARATUS

CROSS-REFERENCE TO RELATED APPLICATION

The present invention claims priority from Patent Application JP2006-297834 filed in the Japanese Patent Office on Nov. 1, 2006, the content of which is hereby incorporated by reference into this application.

BACKGROUND OF THE INVENTION

The present invention relates to an intermittent drive mechanism, a sheet feeder, and an image forming apparatus.

JP-A-9-236163 discloses a conventional, intermittent drive mechanism. The intermittent drive mechanism is provided on, for example, a sheet feeder provided on an image forming apparatus.

More specifically, the intermittent drive mechanism comprises a drive gear, a fragmental gear, and a first cam, which rotates integrally with the fragmental gear. The fragmental gear includes a mesh portion, whose teeth arranged in a predetermined region on a circumference mesh with the drive gear, and a non-mesh portion, which is free of teeth in the remaining region on the circumference and so does not mesh with the drive gear.

Also, the intermittent drive mechanism comprises a bias spring, an operating arm, and an operating-arm drive mechanism, which drives the operating arm upon energization of a solenoid. The bias spring contacts with the first cam to rotate the fragmental gear so as to bring about a mesh state, in which the mesh portion meshes with the drive gear, from an optional, initial position in a non-mesh state, in which the non-mesh portion faces the drive gear. The operating arm engages with the fragmental gear to restrict rotation of the fragmental gear only when the fragmental gear is disposed in the initial position.

The conventional intermittent drive mechanism constructed in this manner can drive the fragmental gear intermittently in the following manner.

First, in a state, in which the fragmental gear stops in the initial position, the operating-arm drive mechanism does not carry an electric current to the solenoid and the operating arm engages with the fragmental gear to restrict rotation of the fragmental gear. At this time, the bias spring contacts with the first cam while conserving a bias force.

Subsequently, when intermittent driving of the fragmental gear starts, the operating-arm drive mechanism carries an electric current to the solenoid to drive the operating arm. Therefore, the operating arm does not engage with the fragmental gear and so rotation of the fragmental gear is not restricted. Therefore, the bias spring biases the first cam whereby the fragmental gear rotates and the fragmental gear is put in a mesh state. Consequently, the driving force of the drive gear is transmitted to the fragmental gear, so that the fragmental gear rotates.

Further, when the fragmental gear rotates to be again put in a non-mesh state, the driving force of the drive gear is not transmitted to the fragmental gear. Therefore, the fragmental gear rotates to the initial position due to inertia and the bias on the first cam by the bias spring. Here, since the operating-arm drive mechanism does not carry an electric current to the solenoid except at the start of intermittent driving, the operating arm engages again with the fragmental gear. Consequently, the operating arm restricts rotation of the fragmental gear and so the fragmental gear remains in the initial position.

Thus the conventional intermittent drive mechanism enables intermittent driving of the fragmental gear. The intermittent drive mechanism is provided on, for example, a sheet feeder to drive a sheet feed gear directly or indirectly, thus enabling intermittently rotating a pickup roller, which is driven by the sheet feed gear. Therefore, an image forming apparatus provided with such sheet feeder can form an image on sheets fed one by one by the pickup roller, or the like.

By the way, noise reduction at the time of sheet feed is demanded of image forming apparatuses and sheet feeders in order to achieve a decrease in discomfort on the part of a user, and noise reduction is also demanded of the conventional intermittent drive mechanisms.

BRIEF SUMMARY OF THE INVENTION

The invention has been thought of in view of the conventional situation described above and has its object to provide an intermittent drive mechanism capable of noise reduction.

Having examined the cause of generation of noise in order to solve the problem, the inventors of the present application have paid attention especially to the following cause of generation, which possibly makes a user feel uneasy.

That is, with the conventional intermittent drive mechanism, the operating-arm drive mechanism carries an electric current to the solenoid to drive the operating arm when intermittent driving of the fragmental gear starts. When the operating arm gets out of engagement with the fragmental gear, no load is put on the operating arm, so that the operating arm quickly operates to collide against a stopper to stop. At the time of such collision, the intermittent drive mechanism is liable to generate a large collision noise. Also, when the operating arm gets out of engagement with the fragmental gear at the start of intermittent driving and when the operating arm gets into engagement with the fragmental gear at the termination of intermittent driving, collision noise "snap" is liable to be generate. While there is a fear that such collision noise makes a user feel uncomfortableness of "noise is large", it is generated always in a normal operating state and any trouble such as failure, etc. is not caused. Since such collision noise resembles sound generated when a resin part breaks, or a gear jumps a tooth or teeth, however, there is a fear that a user entertains an uneasy feeling "some part or parts are broken", and so it is preferable to reduce the collision noise.

The inventors of the present application have earnestly studied in order to dissolve the cause of generation of noise and reached the invention.

The intermittent drive mechanism according to the invention comprises a drive gear, a fragmental gear, a first cam, an operating arm, an operating-arm drive mechanism, and a brake mechanism. The fragmental gear includes a mesh portion, of which teeth arranged in a predetermined region on a circumference mesh with the drive gear, and a non-mesh portion, which is free of teeth in the remaining region on the circumference and so does not mesh with the drive gear. The first cam rotates integrally with the fragmental gear. The operating arm contacts with the first cam to rotate the fragmental gear so as to put the same in a mesh state, in which the mesh portion meshes with the drive gear, from an optional, initial position in a non-mesh state, in which the non-mesh portion faces the drive gear. The operating-arm drive mechanism drives the operating arm upon energization of a solenoid. The brake mechanism restricts rotation of the fragmental gear at least when the fragmental gear is disposed in the initial position.

The intermittent drive mechanism, according to the invention, constructed in this manner can drive the fragmental gear intermittently in the following manner.

First, in a state, in which the fragmental gear stops in the initial position, the brake mechanism restricts rotation of the fragmental gear. At this time, the operating-arm drive mechanism does not carry an electric current to the solenoid and does not drive the operating arm, so that the operating arm contacts with the first cam or separates slightly therefrom.

Subsequently, when intermittent driving begins, the operating-arm drive mechanism carries an electric current to the solenoid to drive the operating arm. Therefore, the operating arm contacts with the first cam to rotate the fragmental gear. Therefore, the fragmental gear is put in a mesh state from an optional, initial position in a non-mesh state. Consequently, the driving force of the drive gear is transmitted to the fragmental gear, so that the fragmental gear rotates.

Further, when the fragmental gear rotates to be put in a non-mesh state again, the driving force of the drive gear is not transmitted to the fragmental gear. Therefore, the fragmental gear rotates to the initial position due to inertia. Here, since the brake mechanism restricts rotation of the fragmental gear at least when the fragmental gear is disposed in the initial position, the fragmental gear remains in the initial position. Thus the intermittent drive mechanism according to the invention can drive the fragmental gear intermittently.

Here, with the intermittent drive mechanism according to the invention, the operating-arm drive mechanism operates at low speed while being acted through the operating arm by a reaction force to a push force, which rotates the fragmental gear, when the fragmental gear is caused to rotate from the initial position. Therefore, unlike conventional intermittent drive mechanisms, the intermittent drive mechanism is hard to generate a collision noise since the operating arm does not quickly operate to collide against a stopper to stop. Also, unlike conventional intermittent drive mechanisms, the intermittent drive mechanism is constructed not to engage with the fragmental gear since the operating arm restricts rotation of the fragmental gear, so that a collision noise "snap" is hard to generate between the operating arm and the fragmental gear when intermittent driving starts and terminates.

Accordingly, the intermittent drive mechanism according to the invention is capable of noise reduction. In case of being mounted on a sheet feeder and an image forming apparatus, the intermittent drive mechanism can reduce noise at the time of sheet feed, so that it is possible to eliminate a fear that a user entertains an uneasy feeling "some part or parts may be broken". Also, since the intermittent drive mechanism makes use of a solenoid for the operating-arm drive mechanism, parts cost is inexpensive, control is easy, and manufacturing cost can be decreased.

BRIEF DESCRIPTION OF THE SEVERAL VIEWS OF THE DRAWINGS

An embodiment, in which the invention is embodied, will be described below with reference to the drawings.

DETAILED DESCRIPTION OF THE PREFERRED EMBODIMENTS

Embodiment 1

Figure 1:
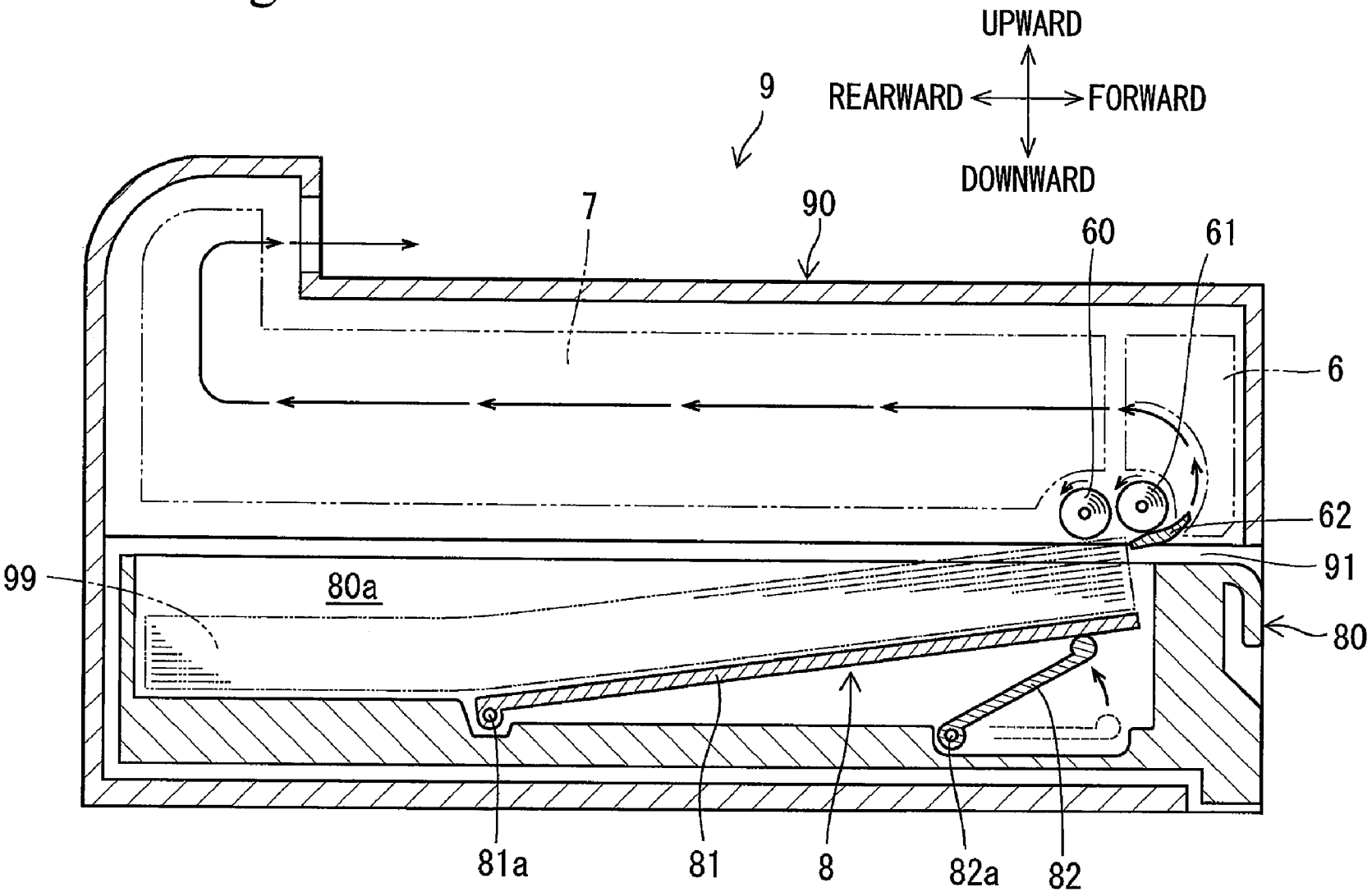
FIG. 1 is a schematic, cross sectional view relating to an intermittent drive mechanism of the embodiment and showing a sheet feeder and an image forming apparatus.
Figure 2:
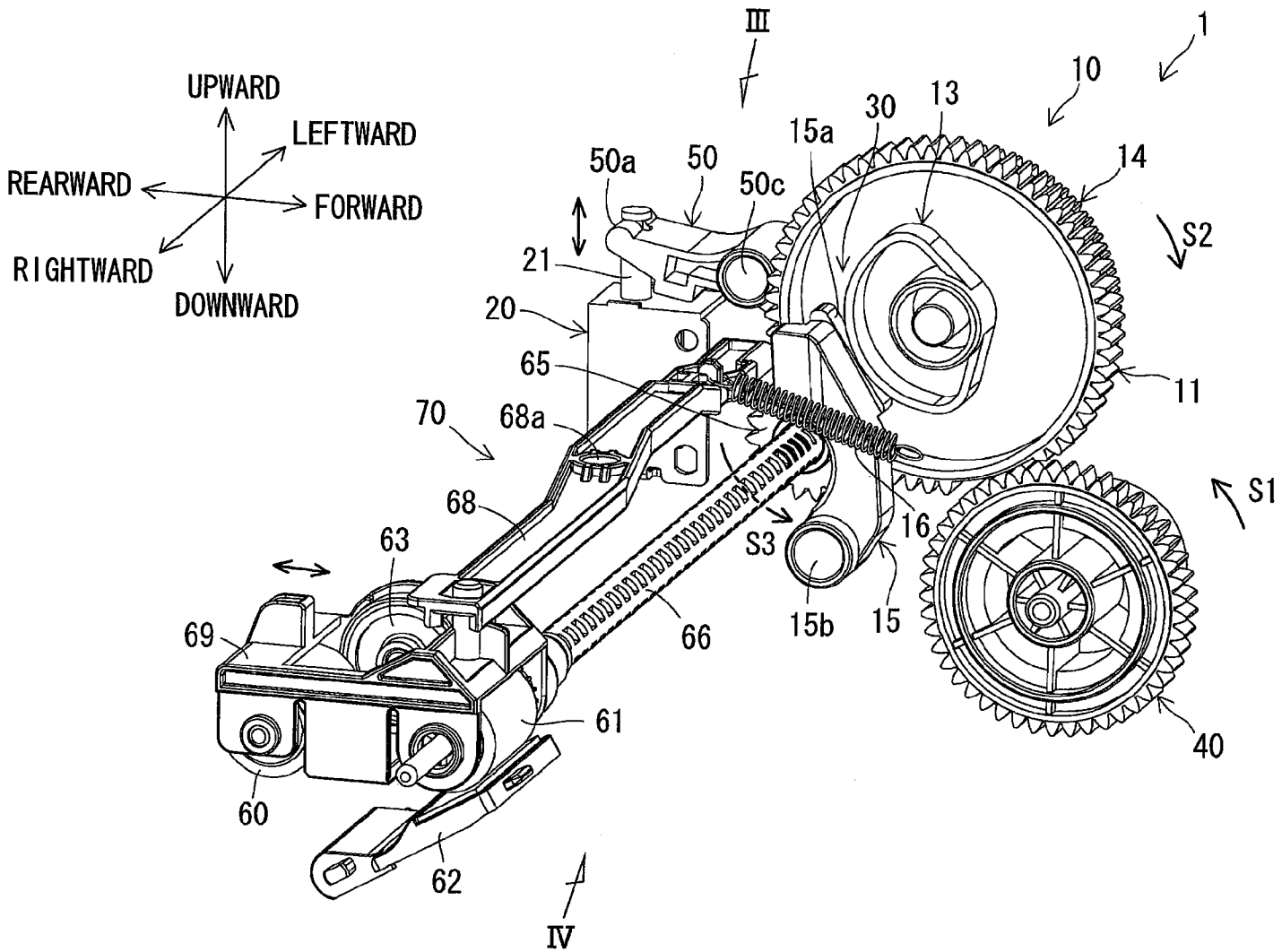
FIG. 2 is a perspective view showing the intermittent drive mechanism of the embodiment.
Figure 3:
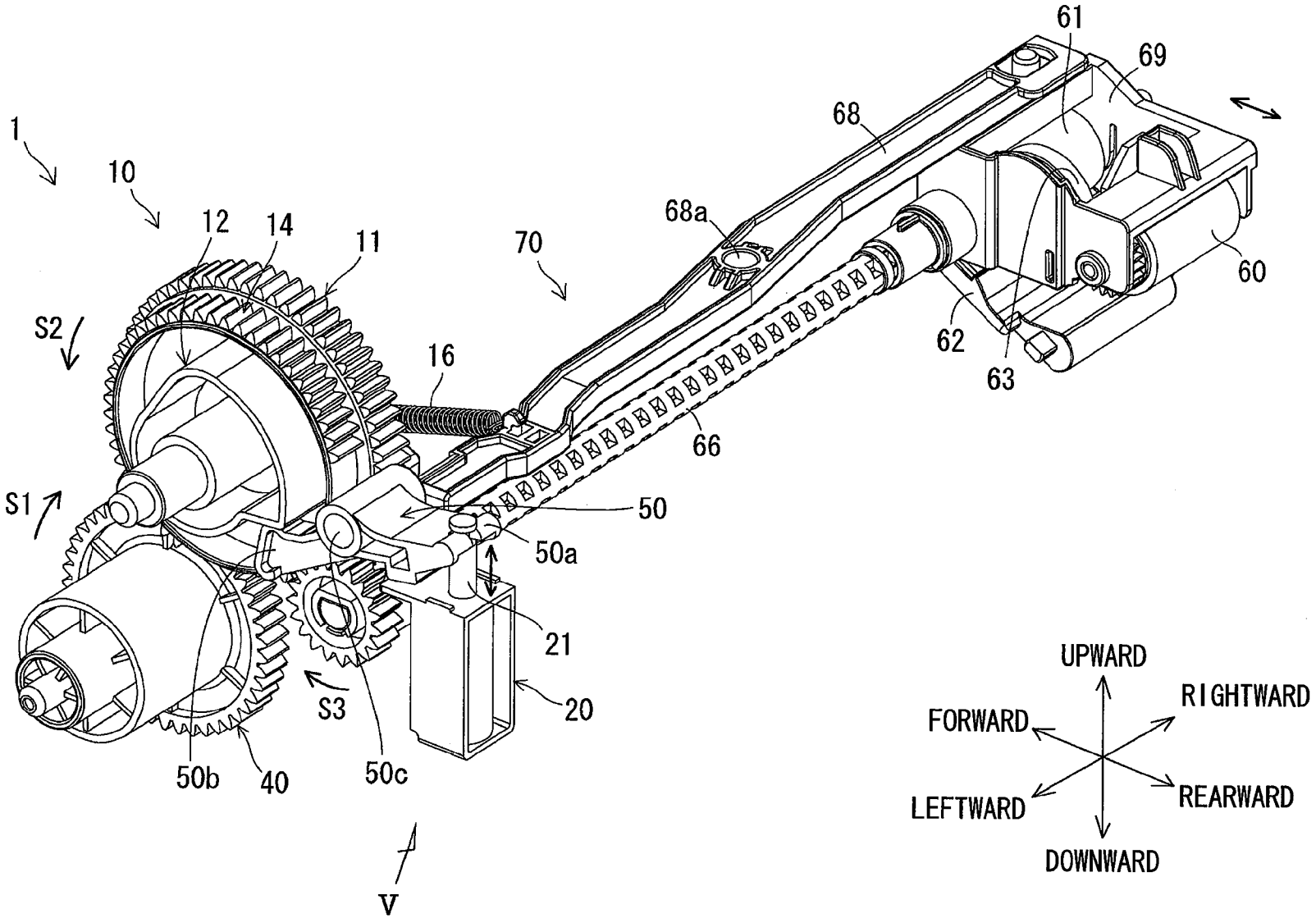
FIG. 3 is a perspective view relating to the intermittent drive mechanism of the embodiment and viewed in a direction of an arrow III in FIG. 2 (a state, in which a fragmental gear is disposed in an initial position)
Figure 4:
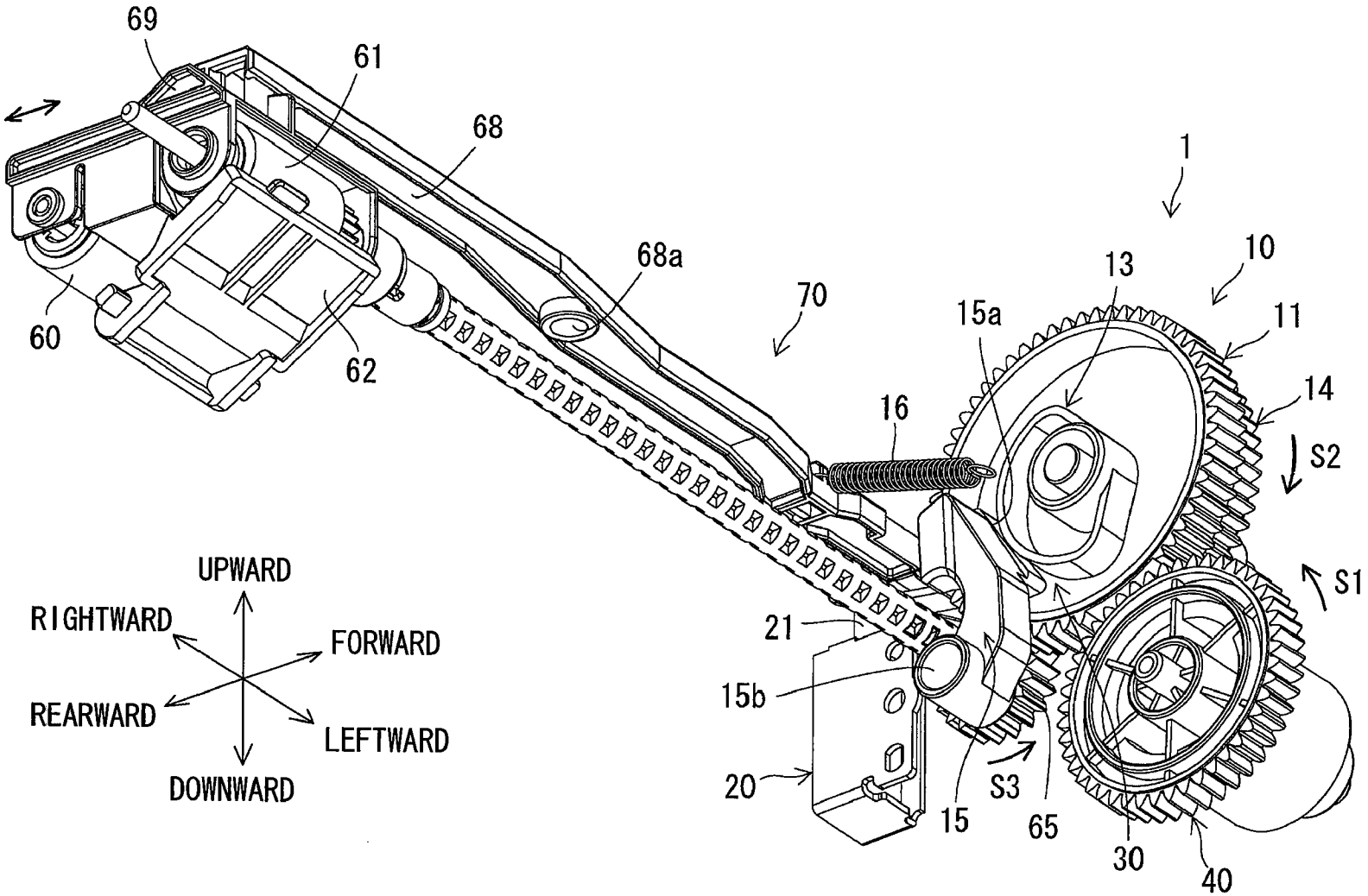
FIG. 4 is a perspective view relating to the intermittent drive mechanism of the embodiment and viewed in a direction of an arrow IV in FIG. 2 (a state, in which the fragmental gear is disposed in the initial position)
Figure 5:
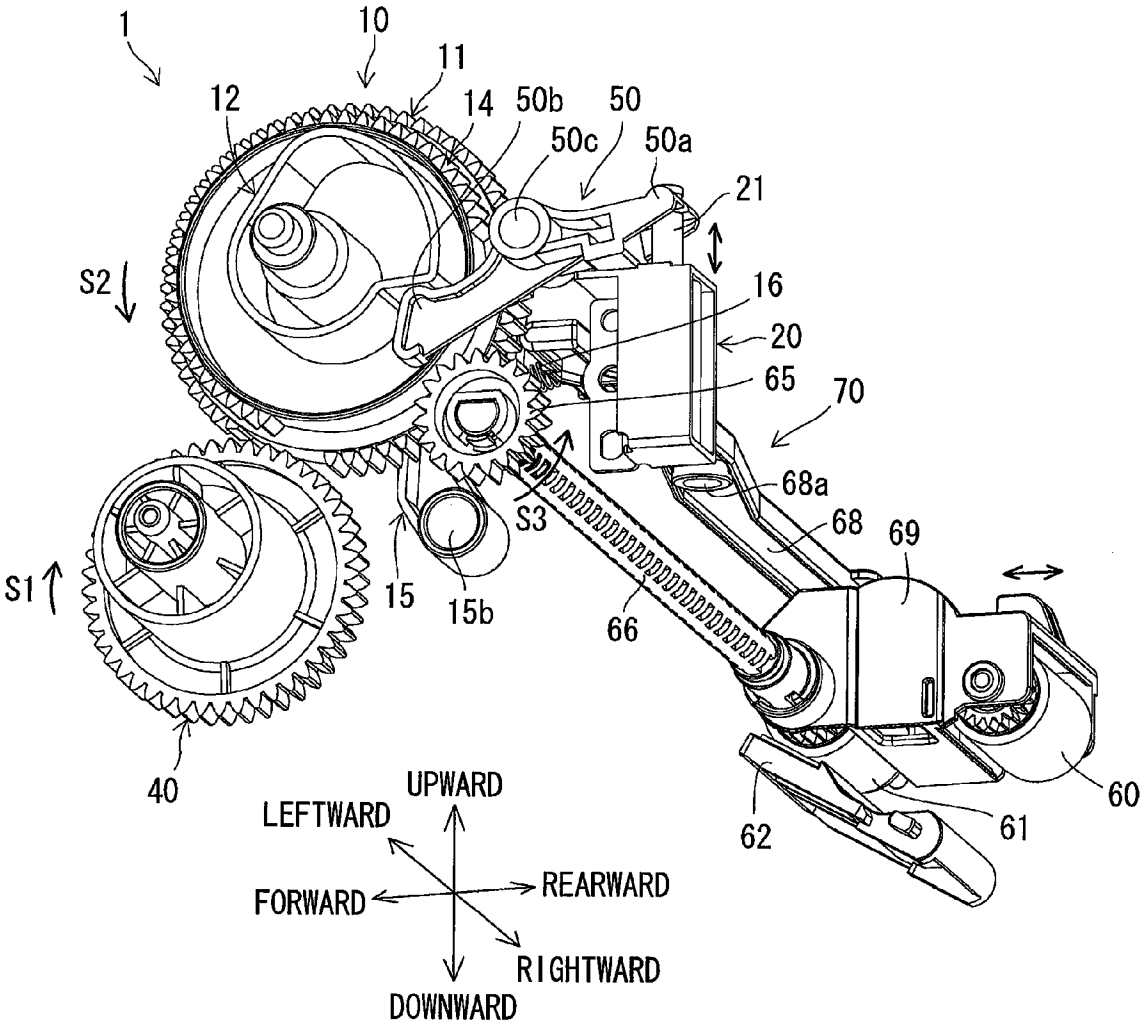
FIG. 5 is a perspective view relating to the intermittent drive mechanism of the embodiment and viewed in a direction of an arrow V in FIG. 3 (a state, in which the fragmental gear is disposed in the initial position)

A intermittent drive mechanism 1 of the embodiment, shown in FIGS. 2 to 6, is applied to a printer 9 as an image forming apparatus shown in FIG. 1. The printer 9 comprises a housing 90 in the form of a substantially rectangular parallelopiped, an image forming section 7 mounted upward in the housing 90, and a sheet feeder 8 mounted downward in the housing 90.

The image forming section 7, details of which are not shown, forms an image on a sheet 99 (for example, paper, OHP sheet) in a general image forming system such as a electrophotographic system, a thermal system, an ink jet system, etc.

The sheet feeder 8 feeds sheets 99 one by one to the image forming section 7 and includes a sheet feed cassette 80, a pickup roller 60, a separation roller 61, a separation pad 62, a sheet feed auxiliary section 6, and the intermittent drive mechanism 1 (not shown in FIG. 1).

The sheet feed cassette 80 is shaped so that it can be mounted to, or removed from a cassette storage portion 91, which is provided concavely to extend rearward from a front side of the housing 90, and includes a storage chamber **80*a* opened upward to enable storing the sheets 99 therein, a push plate 81, and a lever 82**.

The push plate 81 is a substantially rectangular-shaped thin plate provided at a bottom of the storage chamber **80*a* and capable of swinging about a first pivot shaft 81*a* in parallel to a left and right direction (In FIG. 1, a direction to this side from the back of the figure. A direction shown in FIGS. 2 to 5**) so as to be put in a forwardly upwardly inclined state from a horizontal state.

The lever 82 is provided below on a front end side of the push plate 81 to be able to swing about a second pivot shaft 2*a* in parallel to the first pivot shaft 81*a* so as to be put in a forwardly upwardly inclined state from a horizontal state. Lever drive means (not shown) drives the lever 82 whereby a front end of the lever 82 swings upward to push up the front end side of the push plate 81, thus enabling putting the push plate 81 in a forwardly upwardly inclined state.

The pickup roller 60 is provided above a front end side of the storage chamber 80*a*, the separation roller 61 is provided forwardly of the pickup roller 60, and the separation pad 62 is provided below the separation roller 61.

More specifically, as shown in FIGS. 2 to 5, the pickup roller 60 and the separation roller 61 are born by a journal member 69 held on a right end of a support arm 68, which extends in a left and right direction, to be able to rotate about an axis in parallel to the left and right direction. On the other hand, the separation pad 62 is arranged on a side of the housing 90 independently of the pickup roller 60 and the separation roller 61.

The support arm 68 is journaled at a center thereof by a fluctuation shaft 68*a* to be able to swing in a horizontal plane and biased by a spring 16 as an elastic member mounted to a left end thereof so that the journal member 69 is moved rearward. When the sheet feeder 8 performs a sheet feed operation, the support arm 68 swings by virtue of a left end thereof being pushed rearward by a second cam 13 and a cam follower 15, details of which are described later, so that the journal member 69 held at the right end thereof is moved forward. The support arm 68, the spring 16, the second cam 13 and the cam follower 15 constitute a push mechanism 70. When the journal member 69 moves forward, the pickup roller 60 is pushed against a front-end uppermost portion of a sheet 99 pushed up by the push plate 81 in an inclined state as shown in FIG. 1, so that the separation roller 61 is pushed against the separation pad 62. In addition, the spring 16, the second cam 13 and the cam follower 15 constitute the intermittent drive mechanism 1.

A sheet feed drive shaft 66 extending left and right is fixed at a right end thereof to the separation roller 61 as shown in FIGS. 2 to 5, and a sheet feed gear 65 is fixed to a left end of the sheet feed drive shaft 66. The pickup roller 60 meshes through a gear 63 with the separation roller 61. Therefore, when the sheet feed gear 65 rotates in a S3 direction, the pickup roller 60 and the separation roller 61 are also driven by the sheet feed gear 65 to rotate in the S3 direction.

As shown in FIG. 1, the sheet feed auxiliary section 6 is arranged forwardly and upwardly of the separation roller 61 and the separation pad 62 to include a paper powder removal roller mechanism for removal of paper powder attaching to a sheet 99 and a guide mechanism, which guides a sheet 99 rearward in a folding manner to guide the same to the image forming section 7, while these mechanisms are not shown in detail.

As shown in FIGS. 2 to 6, the intermittent drive mechanism 1 is arranged on the left (In FIG. 1, on the back side of the figure) of the pickup roller 60, the separation roller 61, and the separation pad 62 in the housing 90.

The intermittent drive mechanism 1 includes a drive gear 40, a sector gear 10, an operating arm 50, an operating-arm drive mechanism 20, and a brake mechanism 30.

The drive gear 40 is a unitary molding formed by injection molding of a thermoplastic resin such as nylon resin, POM resin, etc., and arranged leftwardly downward in the housing 90 to be able to rotate about an axis in parallel to the left and right direction. When the sheet feeder 8 feeds a sheet 99 one by one to the image forming section 7, the drive gear 40 begins rotation in a S1 direction according to a command from control means (not shown) and continuously rotates until the image forming section 7 forms an image on a sheet 99 and the sheet 99 is discharged from the printer 9.

The sector gear 10 is a unitary molding formed by injection molding of a thermoplastic resin such as nylon resin, POM resin, etc., and arranged rearwardly and upwardly of the drive gear 40 and forwardly and upwardly of the sheet feed gear 65 to be able to rotate about an axis in parallel to the left and right direction. Also, as shown in detail in FIGS. 12 and 13, the sector gear 10 includes a first cam 12, a sheet-feed-gear fragmental gear 14, a fragmental gear 11, and the second cam 13 in order from the left to the right.

The fragmental gear 11 includes a mesh portion 11*a*, of which teeth arranged in a predetermined region on a circumference mesh with the drive gear 40, and a non-mesh portion 11*b*, which is free of teeth in the remaining region on the circumference and so does not mesh with the drive gear 40.

Figure 6:
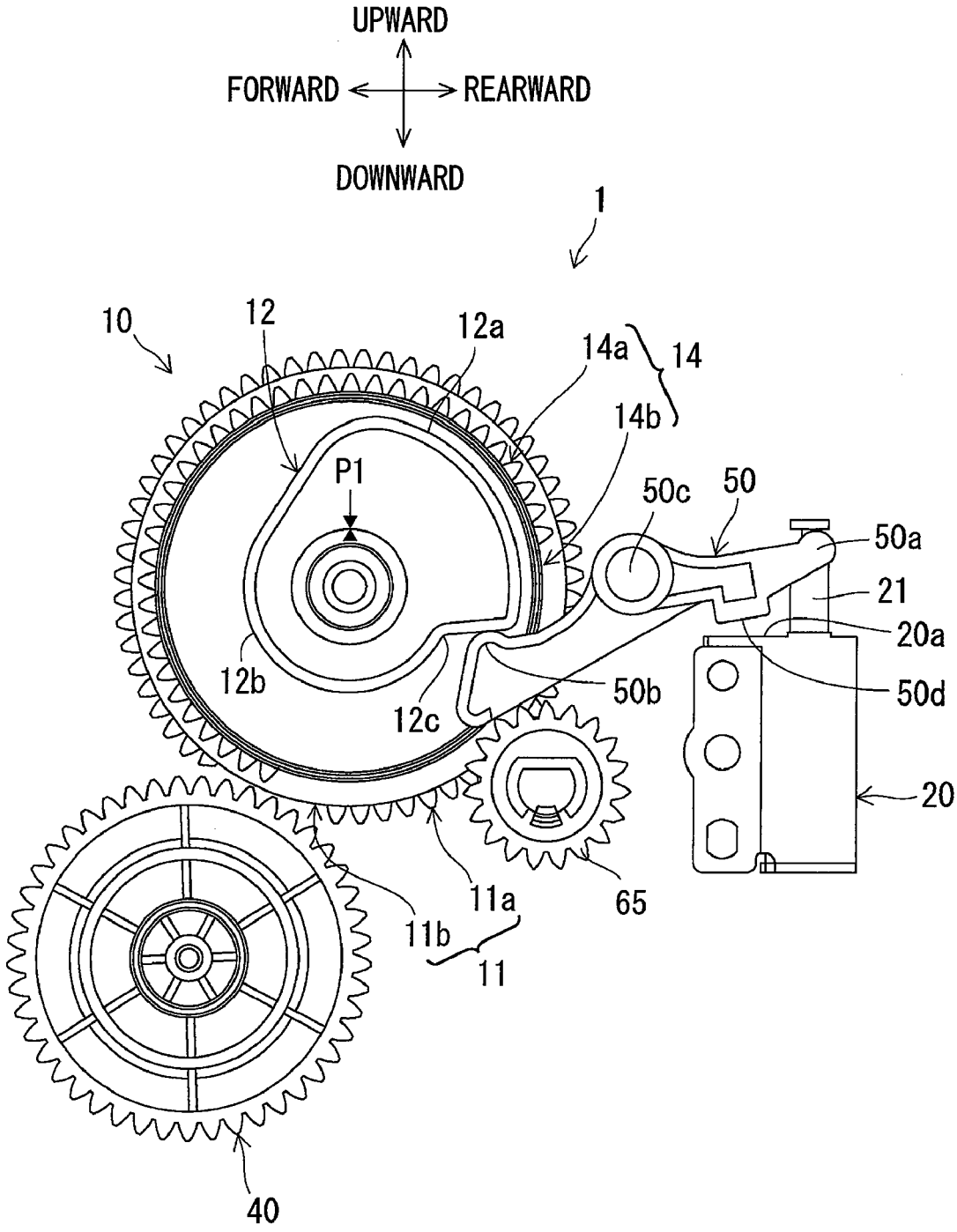
FIG. 6 is a left side view relating to the intermittent drive mechanism of the embodiment and showing a state, in which the fragmental gear is disposed in the initial position.

As shown in FIG. 6, the non-mesh portion 11*b* faces the drive gear 40 in a non-mesh state and as shown in FIGS. 7 to 11, the mesh portion 11*a* meshes with the drive gear 40 in a mesh state. As shown in FIG. 6, an initial position P1, in which the fragmental gear 11 is positioned when the intermittent drive mechanism 1 stops, is determined in the non-mesh state. Also, in the mesh state shown in FIGS. 7 to 11, when the drive gear 40 rotates in the S1 direction, the fragmental gear 11 rotates in a S2 direction and the first cam 12, the second cam 13, and the sheet-feed-gear fragmental gear 14 also rotate together (that is, the whole sector gear 10 rotates in the S2 direction).

Figure 11:
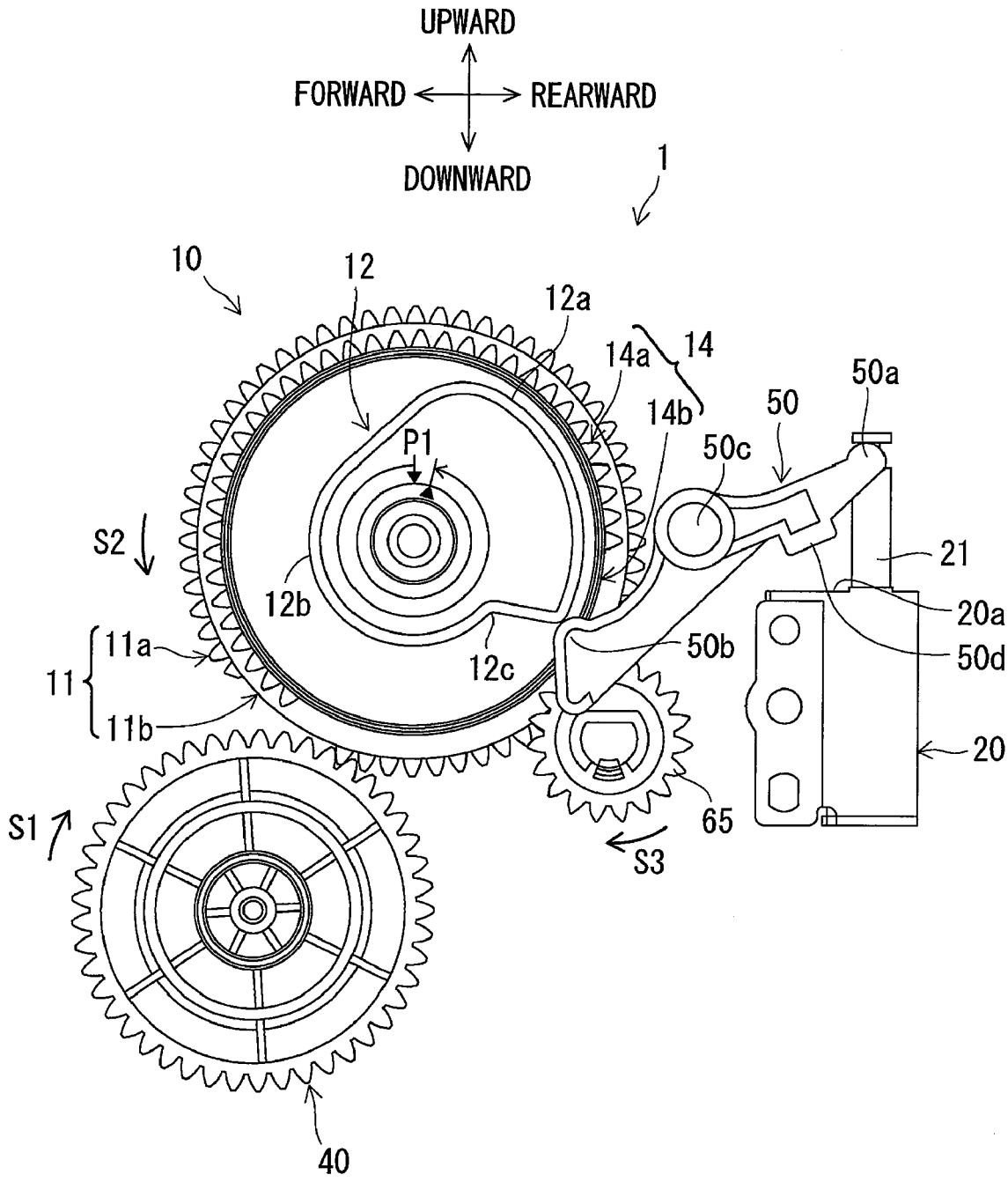
FIG. 11 is a left side view relating to the intermittent drive mechanism of the embodiment and showing a state immediately before a non-mesh state comes out from a mesh state.
Figure 12:
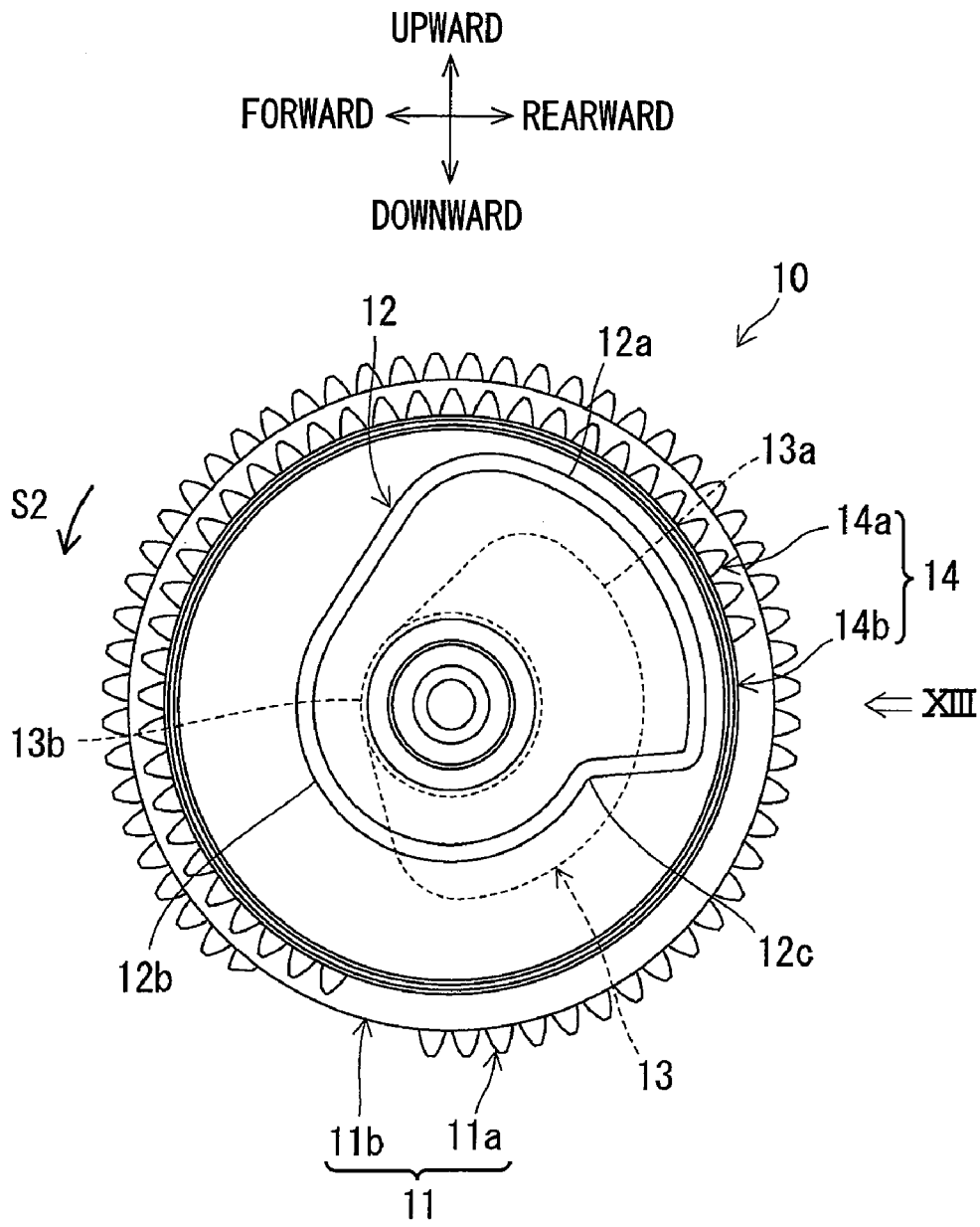
FIG. 12 is a left side view relating to the intermittent drive mechanism of the embodiment and showing a sector gear.
Figure 13:
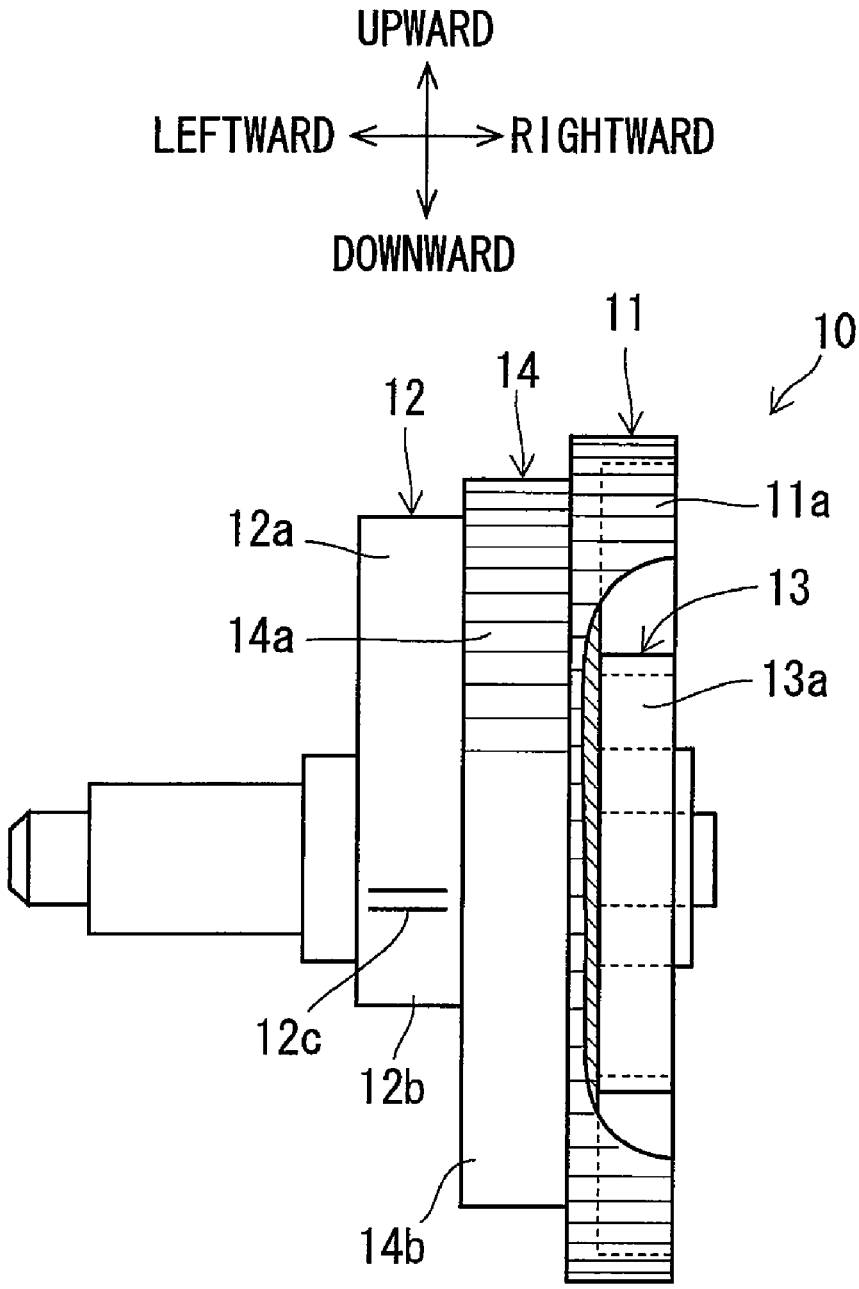
FIG. 13 is a front view relating to the intermittent drive mechanism of the embodiment and showing a sector gear as viewed in a direction of an arrow XIII in FIG. 12.

As shown in FIG. 12, the first cam 12 has a curvilinear profile composed of a large-diameter portion 12*a*, a small-diameter portion 12*b*, and a concave portion 12*c* provided concavely in the S2 direction. As shown in FIGS. 6 to 11, an output portion 50*b* of the operating arm 50 described later contacts with the first cam 12.

Figure 14:
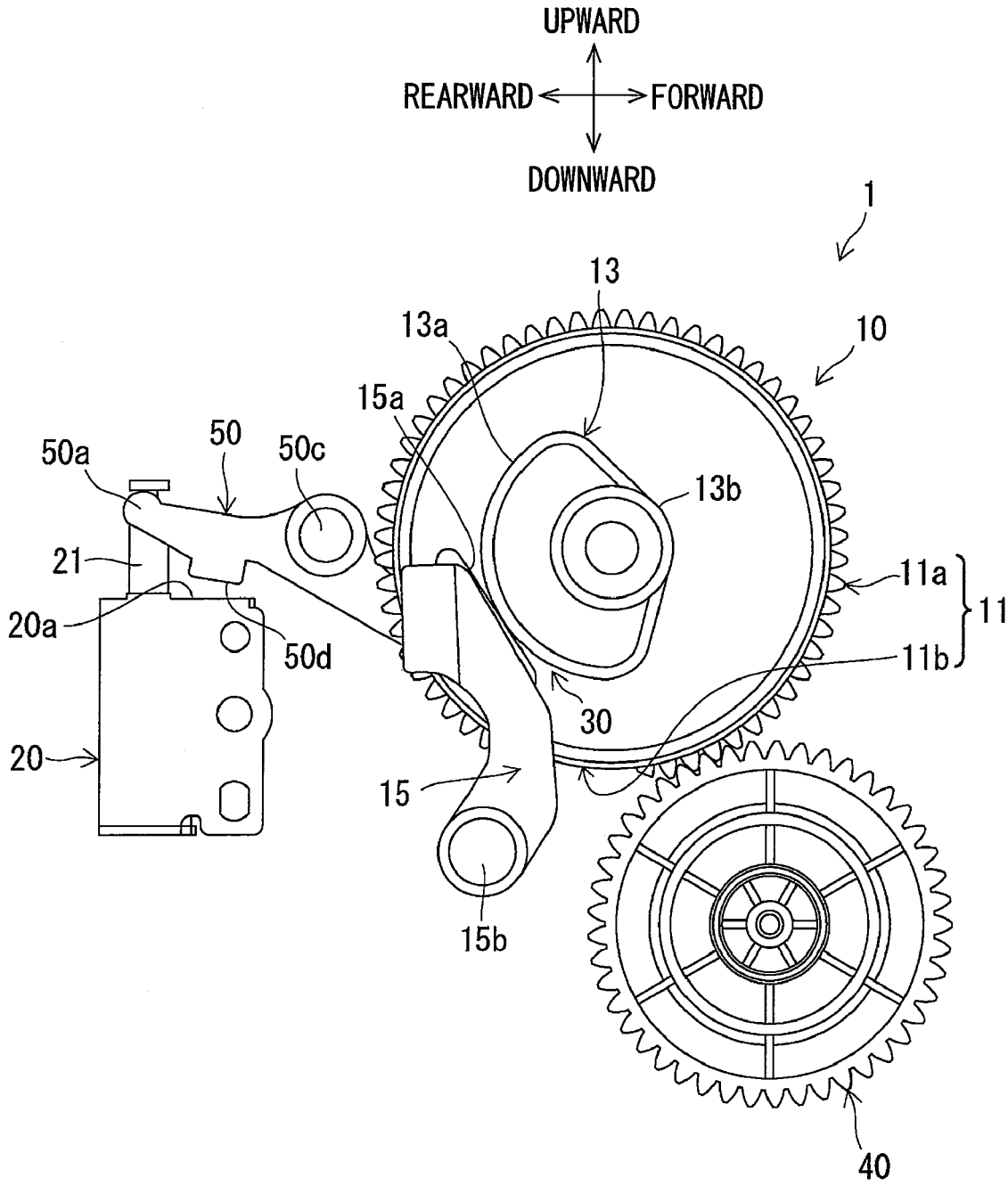
FIG. 14 is a right side view relating to the intermittent drive mechanism of the embodiment and showing a brake mechanism (a state, in which the fragmental gear is disposed in the initial position).

As shown in FIG. 14, the second cam 13 has a substantially sectorial profile composed of a large-diameter portion 13*a* and a small-diameter portion 13*b*. A frictional portion 15*a* of the cam follower 15 described later abuts against the second cam 13.

As shown in FIG. 12, the sheet-feed-gear fragmental gear 14 includes a mesh portion 14*a*, of which teeth arranged in a predetermined region on a circumference mesh with the sheet feed gear 65, and a non-mesh portion 14*b*, which is free of teeth in the remaining region on the circumference and so does not mesh with the sheet feed gear 65. As shown in FIGS. 6 to 11, the sheet-feed-gear fragmental gear 14 rotates in the S2 direction to have the mesh portion 14*a* meshing with the sheet feed gear 65 whereby it is possible to rotationally drive the sheet feed gear 65 in the S3 direction.

As shown in FIGS. 2 to 6, the operating-arm drive mechanism 20 is arranged rearwardly of the first cam 12, an electric current is carried to a built-in solenoid (not shown) thereof to generate a force, which lowers a rod 21 forcedly, and current-carrying is stopped not to generate a force, which lowers the rod 21 forcedly. When intermittent driving begins, the operating-arm drive mechanism 20 carries an electric current to the solenoid and when the fragmental gear is put in a mesh state, carrying of an electric current to the solenoid is stopped. Also, since the operating-arm drive mechanism 20 does not include a return spring for lifting of the rod 21, the rod 21 is put in a state, in which it descends under gravitation, when current-carrying is stopped.

The operating arm 50 includes an input portion 50*a* at a rear end thereof and the output portion 50*b* at a front end thereof, and is journaled at a center thereof by a fluctuation shaft 50*c*, so that the output portion 50*b* can swing vertically in a vertical plane. The input portion 50*a* is positioned above the operating-arm drive mechanism 20 and connected to an upper end of the rod 21. On the other hand, the output portion 50*b* is positioned forwardly and downwardly of the first cam 12.

Figure 7:
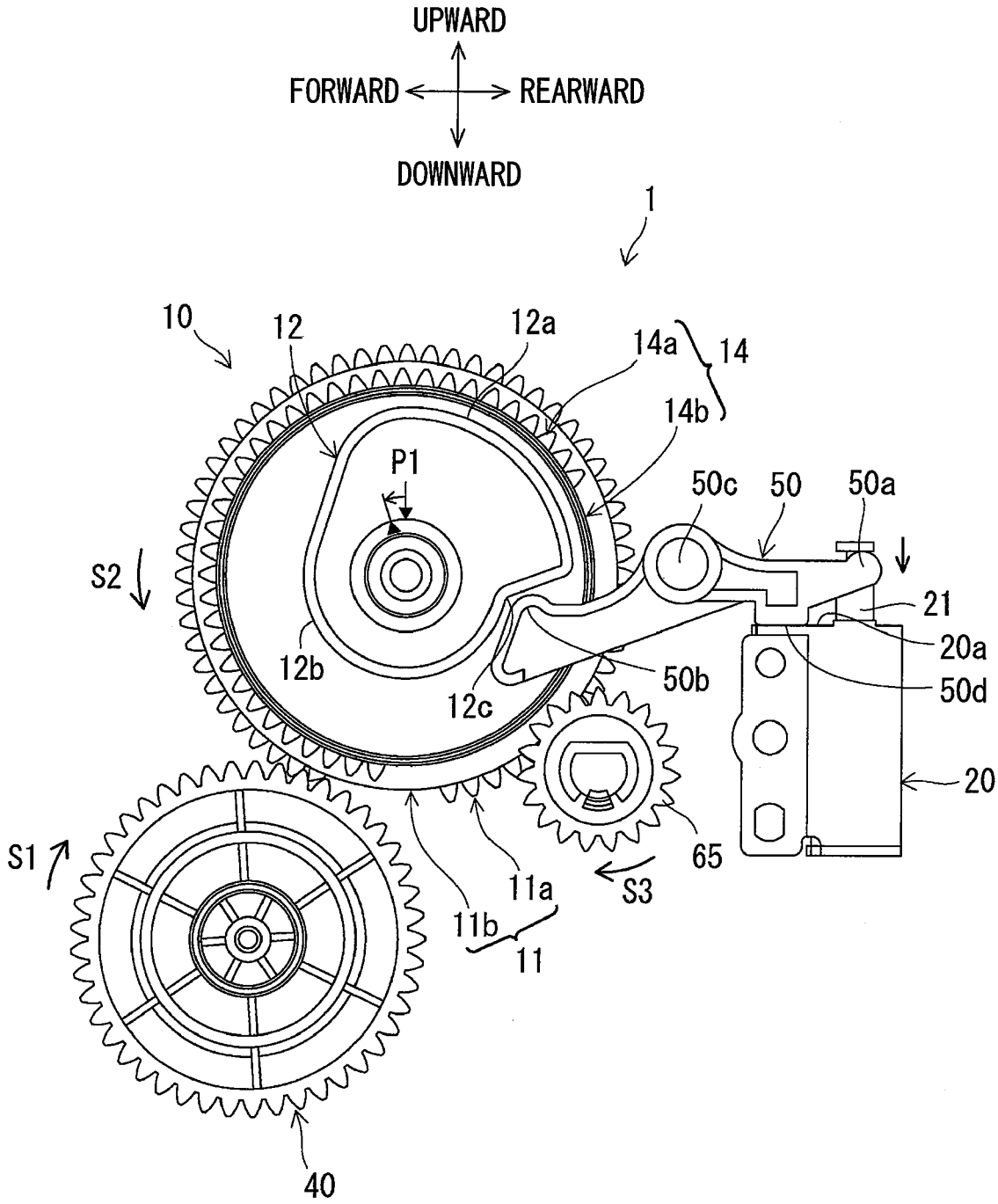
FIG. 7 is a left side view relating to the intermittent drive mechanism of the embodiment and showing a state immediately after a mesh state comes out from a non-mesh state.
Figure 8:
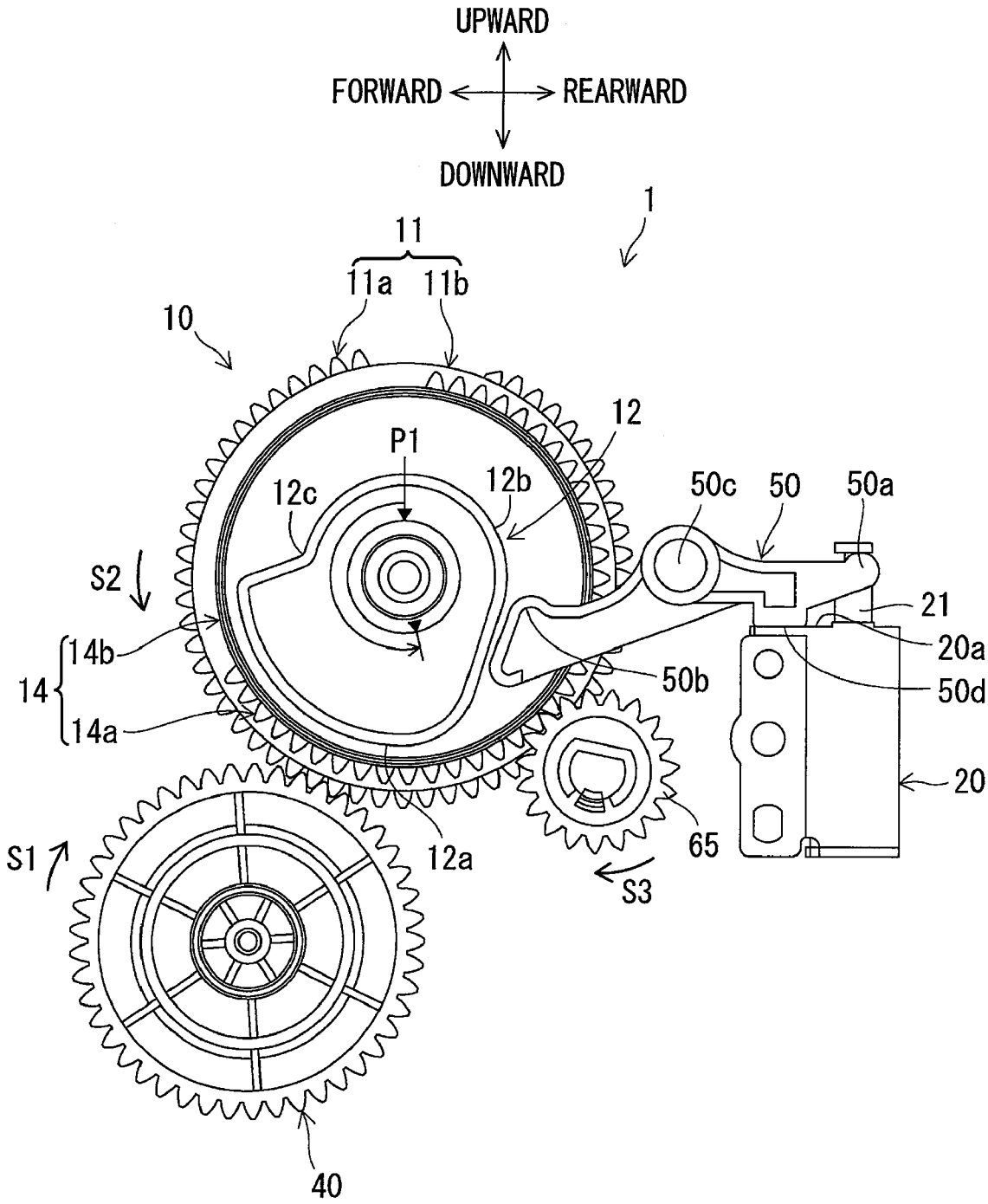
FIG. 8 is a left side view relating to the intermittent drive mechanism of the embodiment and showing a state in the course of a mesh state.

When the operating-arm drive mechanism 20 does not carry an electric current to the solenoid, the rod 21 and the input portion 50*a* are put by the dead weight of the rod 21 in a state of going to descend (the output portion 50*b* is put in a state of ascending by a small force). Therefore, as shown in FIGS. 7 and 8, when the output portion 50*b* faces the small-diameter portion 12*b*, the output portion 50*b* does not contact with the first cam 12 and an abutment stopper 50*d* formed below the input portion 50*a* is put in a state of abutting against a stopper 20*a*. Also, as shown in FIGS. 6 and 9 to 11, when the output portion 50*b* faces the large-diameter portion 12*a* and the concave portion 12*c*, there is brought about a state, in which the output portion 50*b* contacts with the first cam 12 to move up and down and the abutment stopper 50*d* is separated from the stopper 20*a*.

On the other hand, when the operating-arm drive mechanism 20 carries an electric current to the solenoid, there is produced a large force, which lowers the rod 21 forcedly, so that the rod 21 and the input portion 50*a* descend and the output portion 50*b* is caused by a large force to ascend.

As shown in FIGS. 2 to 5 and 14, the brake mechanism 30 comprises the second cam 13, the cam follower 15, and the spring 16 as an elastic member as described above.

A lower end side of the cam follower 15 positioned below the second cam 13 is journaled by a fluctuation shaft 15*b* and the frictional portion 15*a* on an upper side thereof can fluctuate longitudinally in a vertical plane.

The spring 16 pushes the frictional portion 15*a* of the cam follower 15 against the second cam 13 through a left end of the support arm 68.

When the frictional portion 15*a* faces the large-diameter portion 13*a*, the frictional portion 15*a* swings rearward and the spring 16 is elongated much, so that a large reaction force causes the frictional portion 15*a* to push the large-diameter portion 13*a* strongly to generate a large frictional force. Consequently, the brake mechanism 30 restricts rotation of the fragmental gear 11.

On the other hand, when the frictional portion 15*a* faces the small-diameter portion 13*b*, the frictional portion 15*a* swings forward and the spring 16 is not elongated so much, so that a small reaction force causes the frictional portion 15*a* to push the small-diameter portion 13*b* light and so a substantially large frictional force is not generated. Consequently, the brake mechanism 30 does not restrict rotation of the fragmental gear 11.

Also, an arc of the large-diameter portion 13*a* has a length covering a region, in which rotation of the fragmental gear 11 is restricted at least when the fragmental gear 11 is put in a non-mesh state. Therefore, the brake mechanism 30 can restrict rotation of the fragmental gear 11 at least when the fragmental gear 11 is put in a non-mesh state.

The intermittent drive mechanism 1, according to the embodiment, constructed in this manner can drive the fragmental gear 11 intermittently in the following manner.

First, as shown in FIG. 6, in a state, in which the intermittent drive mechanism 1 stops and the fragmental gear 11 is disposed in the initial position P1, the operating-arm drive mechanism 20 does not carry an electric current to the solenoid and does not drive the operating arm 50, so that the output portion 50*b* contacts only with the first cam 12. At this time, as shown in FIG. 14, the frictional portion 15*a* in the brake mechanism 30 pushes the second cam 13 strongly to restrict rotation of the fragmental gear 11, so that the fragmental gear 11 stops.

Subsequently, when the intermittent drive mechanism 1 begins intermittent driving, the operating-arm drive mechanism 20 carries an electric current to the solenoid to drive the operating arm 50 as shown in FIG. 7. Therefore, the output portion 50*b* ascends with a large force to contact with the concave portion 12*c* of the first cam 12 to rotate the fragmental gear 11 in the S2 direction. At this time, the operating-arm drive mechanism 20 is acted through the operating arm 50 by a reaction force to a push force, which rotates the fragmental gear 11, and a frictional force of the brake mechanism 30, so that it operates smoothly at low speed. Consequently, the abutment stopper 50*d* abuts against the stopper 20*a* without generation of collision noise. Thus the fragmental gear 11 shifts to a mesh state from the initial position P1 in a non-mesh state. Correspondingly, the operating-arm drive mechanism 20 stops carrying an electric current to the solenoid.

Figure 9:
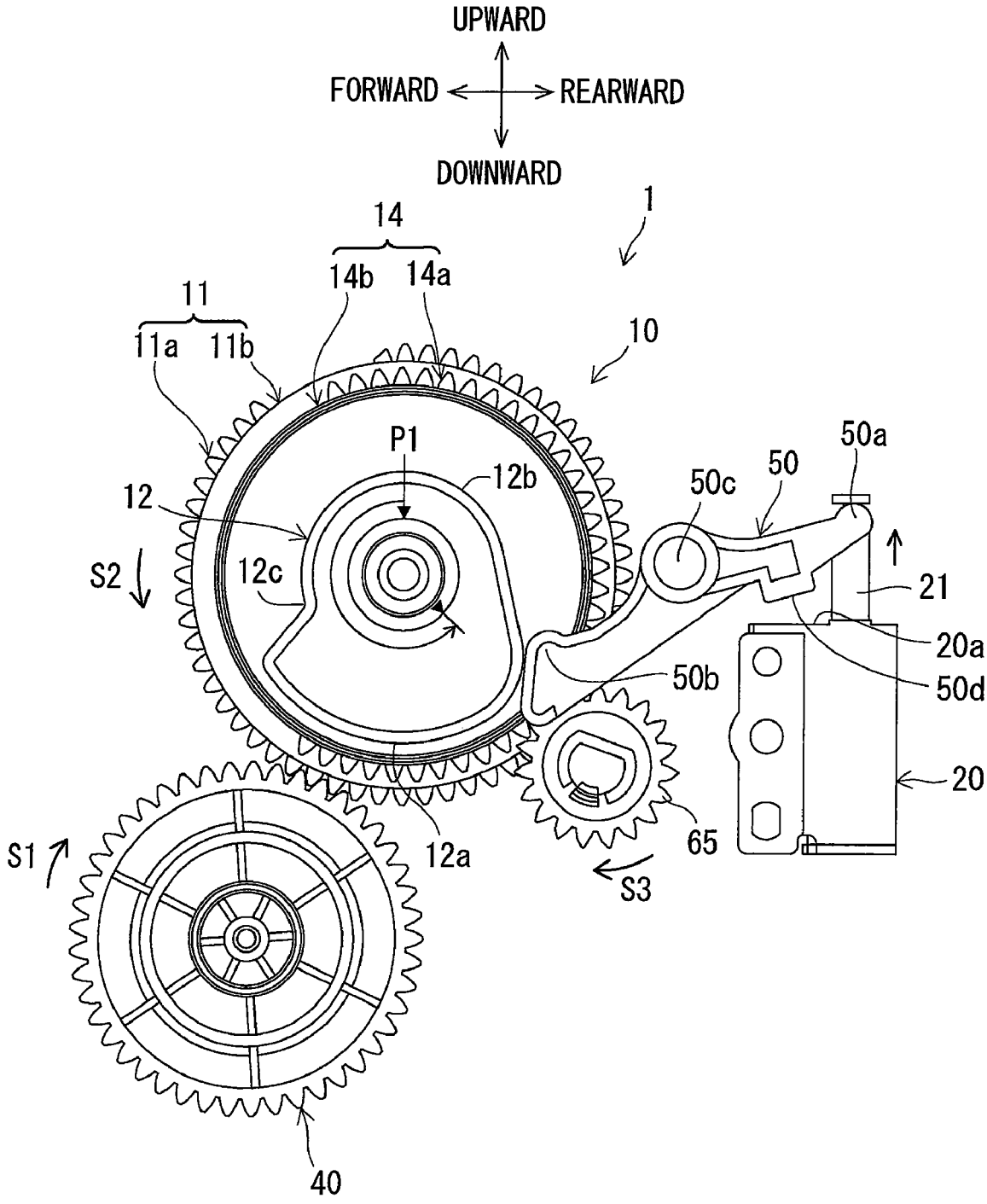
FIG. 9 is a left side view relating to the intermittent drive mechanism of the embodiment and showing a state in the course of a mesh state.
Figure 10:
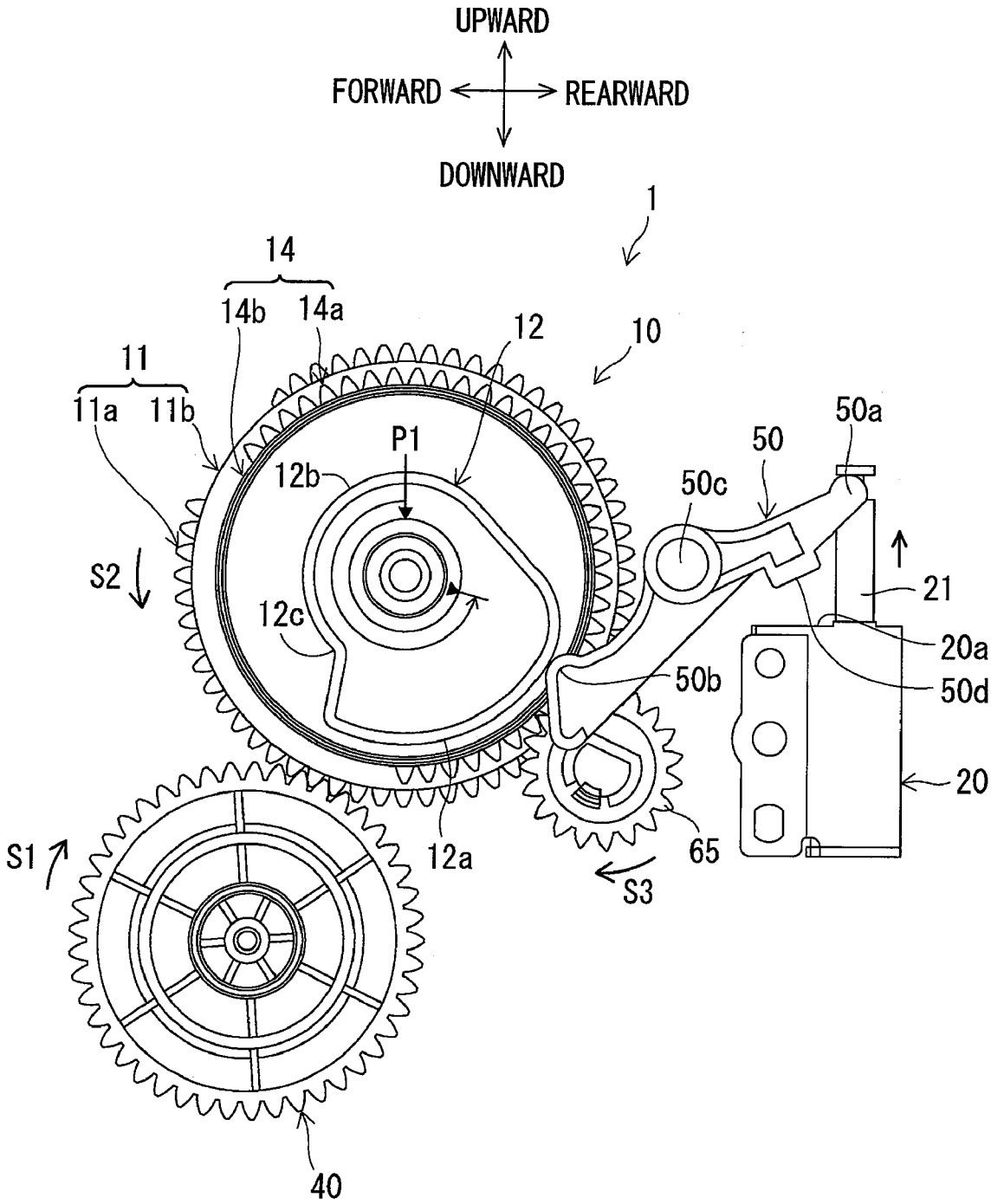
FIG. 10 is a left side view relating to the intermittent drive mechanism of the embodiment and showing a state in the course of a mesh state.

Subsequently, as shown in FIGS. 8 to 10, a driving force of the drive gear 40 is transmitted to the fragmental gear 11 and so the fragmental gear 11 rotates. In the course, as shown in FIGS. 9 and 10, the output portion 50*b* shifts from the small-diameter portion 12*b* to contact with the large-diameter portion 12*a* and swings again downward.

As shown in FIG. 11, when the fragmental gear 11 further rotates to be put in anon-mesh state from a mesh state, a driving force of the drive gear 40 is not transmitted to the fragmental gear 11. Here, the brake mechanism 30 restricts rotation of the fragmental gear 11 not only when the fragmental gear 11 is disposed in the initial position P1, but also when the fragmental gear 11 is put at least in a non-mesh state, so that the fragmental gear 11 rotates by inertia at low speed to stop in the initial position P1 shown in FIG. 6. Thus the intermittent drive mechanism 1 according to the embodiment can drive the fragmental gear 11 intermittently.

The sheet feeder 8 provided with such intermittent drive mechanism 1 performs a sheet feed operation in the following manner.

First, as shown in FIG. 1, the lever 82 swings according to the number of sheets 99 in the storage chamber 80*a* to increase an inclination of the push plate 81. Thereby, a front-end uppermost portion of a sheet 99 is pushed up to approach the pickup roller 60.

Subsequently, the intermittent drive mechanism 1 begins intermittent driving to rotate the pickup roller 60 and the separation roller 61 through the sheet feed gear 65 and the sheet feed drive shaft 66. At this time, upon operation of the second cam 13 and the cam follower 15, the support arm 68 swings to move the journal member 69 forward to push the pickup roller 60 against a front-end uppermost portion of a sheet 99 and to push the separation roller 61 against the separation pad 62. Consequently, the sheet 99 is fed forward by the pickup roller 60 to be conveyed to the sheet feed auxiliary section 6. At this time, in the case where two or more sheets 99 are fed, only an uppermost one is fed intact by the separation roller 61 in the stage of passing between the separation roller 61 and the separation pad 62 and the remainder remains intact due to a frictional force from the separation pad 62.

The sheet 99 is guided rearward turning back with a guide mechanism of the sheet feed auxiliary section 6, etc. and led to the image forming section 7. In this stage, the pickup roller 60 and the separation roller 61 terminate serving to feed the sheet 99, so that upon operations of the second cam 13 and the cam follower 15, the support arm 68 swings in a reverse direction to move the journal member 69 rearward to separate the pickup roller 60 from the front-end uppermost portion of the sheet 99 and to separate the separation roller 61 from the separation pad 62. At the same time, the intermittent drive mechanism 1 stops intermittent driving, so that the pickup roller 60 and the separation roller 61 do not rotate.

The sheet 99 is formed with an image in the image forming section 7 and discharged outside the printer 9. In this manner, the sheet feeder 8 can feed sheets 99 one by one to the printer 9.

Here, when the fragmental gear 11 is rotated from the initial position P1, the operating-arm drive mechanism 20 in the intermittent drive mechanism 1 according to the embodiment operates at low speed while being acted through the operating arm 50 by a reaction force to a push force, which rotates the fragmental gear 11. Therefore, unlike conventional intermittent drive mechanisms, the intermittent drive mechanism 1 is hard to generate a collision noise since the operating arm 50 does not quickly operate to have the abutment stopper 50*d* colliding against and stopping at the stopper 20*a*. Also, unlike conventional intermittent drive mechanisms, the intermittent drive mechanism 1 is constructed not to engage with the fragmental gear 11 since the operating arm 50 restricts rotation of the fragmental gear 11, so that a collision noise "snap" is hard to generate between the operating arm 50 and the fragmental gear 11 when intermittent driving starts and terminates.

Accordingly, the intermittent drive mechanism 1 according to the embodiment can reduce noise. In case of being mounted on the printer 9 as the image forming apparatus and the sheet feeder 8, the intermittent drive mechanism 1 can reduce noise at the time of sheet feed to eliminate a fear that a user entertains an uneasy feeling of "some part may be broken". Also, since the intermittent drive mechanism 1 makes use of a solenoid for the operating-arm drive mechanism 20, parts are inexpensive, control is easy, and manufacturing cost can be decreased.

Also, with the intermittent drive mechanism 1, the fragmental gear 11 is driven by the drive gear 40 when being in a mesh state, so that the necessity of being driven by the operating-arm drive mechanism 20 and the operating arm 50 is small. Therefore, in a state, in which the fragmental gear 11 is put in a mesh state, the operating-arm drive mechanism 20 stops carrying an electric current to the solenoid whereby the intermittent drive mechanism 1 can achieve saving of electric power without detracting reliability in operation.

Further, with the intermittent drive mechanism 1, the brake mechanism 30 restricts rotation of the fragmental gear 11 at least when the fragmental gear 11 is put in a non-mesh state, the operating-arm drive mechanism 20 operates at low speed while being acted by a predetermined load from the brake mechanism 30 as described above. Therefore, since the operating-arm drive mechanism 20 can operate further smoothly, the intermittent drive mechanism 1 becomes further hard to generate a collision noise.

Also, with the intermittent drive mechanism 1, the brake mechanism 30 comprises the second cam 13, which rotates integrally with the fragmental gear 11, the cam follower 15 in contact with the second cam 13, and the spring 16 serving as an elastic member to push the cam follower 15 against the second cam 13. The intermittent drive mechanism 1 can restrict rotation of the fragmental gear 11 owing to a frictional force between the second cam 13 and the cam follower 15, thus enabling producing the function and effect of the invention with a simple constitution. Also, the intermittent drive mechanism 1 can make use of the second cam 13 and the cam follower 15, which constitute the brake mechanism 30, for driving of the push mechanism 70. That is, as the cam follower 15 swings, the support arm 68 swings to enable the pickup roller 60 to be pushed against a front-end uppermost portion of a sheet 99. Therefore, the intermittent drive mechanism 1 can make the manufacturing cost further inexpensive.

Further, the sheet feeder 8 comprises the intermittent drive mechanism 1 according to the embodiment, the sheet feed gear 65 driven indirectly by the fragmental gear 11, and the pickup roller 60 driven by the sheet feed gear 65. Therefore, owing to the function and effect produced by the intermittent drive mechanism 1, the sheet feeder 8 can reduce noise when the pickup roller 60 rotates intermittently, thus enabling reducing noise at the time of sheet feed.

Also, since the spring 16 as an elastic member in the sheet feeder 8 is used commonly by the brake mechanism 30 and the push mechanism 70, parts can be reduced in number and miniaturization of the sheet feeder and reduction in manufacturing cost can be realized.

Further, since the sheet feeder 8 makes use of the spring 16 as an elastic member, it is possible to realize the function and effect of the invention with a simple constitution.

Also, owing to the function and effect produced by the sheet feeder 8, the printer 9 as an image forming apparatus enables reducing noise at the time of sheet feed.

While the invention has been described by way of the embodiment, it goes without saying that the invention is not limited to the embodiment but can be appropriately changed and applied within a scope not departing from the gist thereof.

For example, the sheet feed gear and the pickup roller may be connected together by a drive shaft to rotate integrally, or a mechanical element such as a gear for transmission of a driving force between the both may be interposed therebetween.

The invention can be used for intermittent drive mechanisms, sheet feeders, and image forming apparatuses.

The invention claimed is:

1. An intermittent drive mechanism comprising a drive gear, a fragmental gear including a mesh portion, of which teeth arranged in a predetermined region on a circumference mesh with the drive gear in a drive gear mesh position, and a non-mesh portion, which is free of teeth in the remaining region on the circumference and so does not mesh with the drive gear in the drive gear mesh position, a first cam, which rotates integrally with the fragmental gear, an operating arm, which is configured to contact the first cam to rotate the fragmental gear which causes the mesh portion to mesh with the drive gear in the drive gear mesh position, from a position in which the non-mesh portion is in the drive gear mesh position and the mesh portion is not in the drive gear mesh position, an operating-arm drive mechanism, which is configured to drive the operating arm upon energization of a solenoid, and a brake mechanism, which is configured to restrict rotation of the fragmental gear at least when the non-mesh portion is in the drive gear mesh position and the mesh portion is not in the drive gear mesh position.

2. The intermittent drive mechanism according to claim 1, wherein the operating-arm drive mechanism is configured to stops energization of the solenoid when the mesh portion is in the drive gear mesh position.

3. The intermittent drive mechanism according to claim 1, wherein the brake mechanism is configured to restrict rotation of the fragmental gear at least when the non-mesh portion is in the drive gear mesh position and the mesh portion is not in the drive gear mesh position.

4. The intermittent drive mechanism according to claim 1, wherein the brake mechanism includes a second cam, which rotates integrally with the fragmental gear, a cam follower, which comes into contact with the second cam, and an elastic member, which pushes the cam follower against the second cam.

5. A sheet feeder comprising an intermittent drive mechanism, a sheet feed gear, and a pickup roller, and wherein the intermittent drive mechanism comprises a drive gear, a fragmental gear including a mesh portion, of which teeth arranged in a predetermined region on a circumference mesh with the drive gear in a drive gear mesh position, and a non-mesh portion, which is free of teeth in the remaining region on the circumference and so does not mesh with the drive gear in the drive gear mesh position, a first cam, which rotates integrally with the fragmental gear, an operating arm, which is configured to contact the first cam to rotate the fragmental gear which causes the mesh portion to mesh with the drive gear in the drive gear mesh position, from a position in which the non-mesh portion is in the drive gear mesh position and the mesh portion is not in the drive gear mesh position, an operating-arm drive mechanism, which is configured to drive the operating arm upon energization of a solenoid, and a brake mechanism, configured to restrict rotation of the fragmental gear at least when the non-mesh portion is in the drive gear mesh position and the mesh portion is not in the drive gear mesh position, the brake mechanism including a second cam configured to rotate integrally with the fragmental gear, a cam follower configured to come into contact with the second cam, and an elastic member configured to push the cam follower against the second cam, and wherein the sheet feed gear is configured to be driven directly or indirectly by the fragmental gear, and the pickup roller is configured to be driven by the sheet feed gear.

6. The sheet feeder according to claim 5, wherein the elastic member is configured to push the pickup roller against a sheet.

7. The sheet feeder according to claim 6, wherein the elastic member comprises a spring.

8. An image forming apparatus comprising a sheet feeder, which includes an intermittent drive mechanism, a sheet feed gear, and a pickup roller, and wherein the intermittent drive mechanism comprises:

a drive gear, a fragmental gear including a mesh portion, of which teeth arranged in a predetermined region on a circumference mesh with the drive gear in a drive gear mesh position, and a non-mesh portion, which is free of teeth in the remaining region on the circumference and so does not mesh with the drive gear in the drive gear mesh position, a first cam, which rotates integrally with the fragmental gear, an operating arm, which is configured to contact the first cam to rotate the fragmental gear which causes the mesh portion to mesh with the drive gear in the drive gear mesh position, from a position in which the non-mesh portion is in the drive gear mesh position and the mesh portion is not in the drive gear mesh position, an operating-arm drive mechanism, which is configured to drive the operating arm upon energization of a solenoid, and a brake mechanism, configured to restrict rotation of the fragmental gear at least when the non-mesh portion is in the drive gear mesh position and the mesh portion is not in the drive gear mesh position, the brake mechanism including a second cam configured to rotate integrally with the fragmental gear, a cam follower configured to come into contact with the second cam, and an elastic member configured to push the cam follower against the second cam, and wherein the sheet feed gear is configured to be driven directly or indirectly by the fragmental gear, and the pickup roller is configured to be driven by the sheet feed gear.

* * * * *